US005915817A

United States Patent [19]

Zagorzycki

[11] Patent Number: 5,915,817

[45] **Date of Patent: *Jun. 29, 1999**

[54] PROCESS FOR DRYING PARTICULATE MATTER

[75] Inventor: Peter E. Zagorzycki, Lansdale, Pa.

[73] Assignee: Wolverine (Massachusetts) Corporation Proctor & Schwartz Division, Horsham, Pa.

[21] Appl. No.: 09/083,582

[22] Filed: May 21, 1998

Related U.S. Application Data

[60] Provisional application No. 60/047,929, May 29, 1997.

[51] Int. Cl.[6] ..... F26B 3/00

[52] U.S. Cl. ..... 34/446; 34/500; 34/164; 34/210

[58] Field of Search ..... 34/446, 447, 484, 34/500, 561, 164, 210, 218, 452, 481, 482, 483, 485, 487, 491, 493

[56] References Cited

U.S. PATENT DOCUMENTS 5,341,580 8/1994 Teal ..... 34/446

*Primary Examiner*—Henry Bennett
*Assistant Examiner*—Pamela A. Wilson
*Attorney, Agent, or Firm*—Howson and Howson

[57] ABSTRACT

A process for drying flammable cellulosic materials such as wood strands that involves maintaining the temperature and humidity of the drying medium above predetermined values to obtain certain stated advantages.

6 Claims, 1 Drawing Sheet

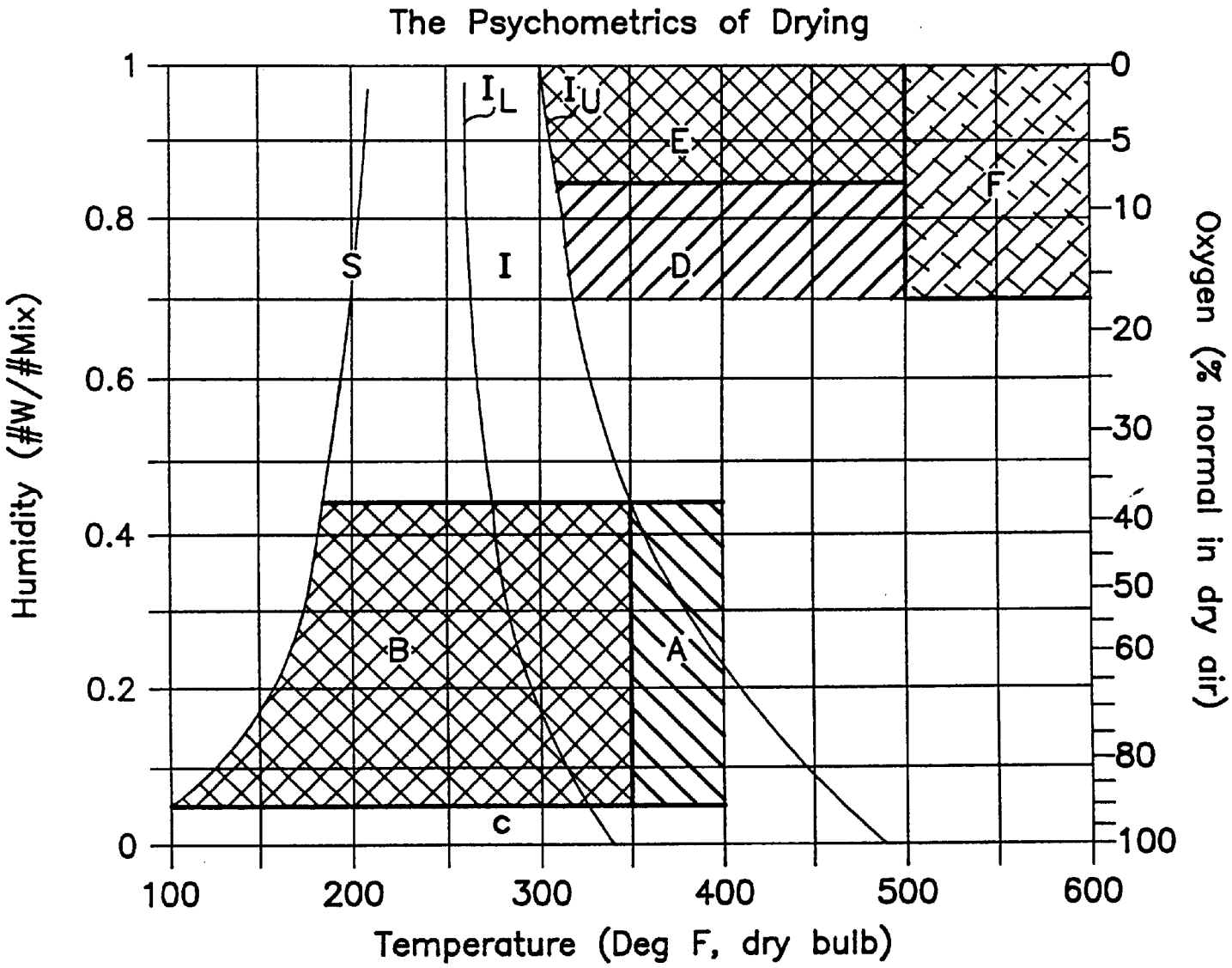
The Psychometrics of Drying
Oxygen (% normal in dry air)
0
5
10
20
30
40
50
60
80
100
Humidity (#W/#Mix)
1
0.8
0.6
0.4
0.2
0
Temperature (Deg F, dry bulb)
100
200
300
400
500
600
S
I
L
I
U
E
D
F
A
B
C

PROCESS FOR DRYING PARTICULATE MATTER

This application claims the benefit of U.S. provisional application No. 60/047,929, filed May 29, 1997.

FIELD OF THE INVENTION

The present invention relates a process for drying particulate matter, and more particularly, the present invention relates to a process for drying flammable cellulosic material such as wood strands.

BACKGROUND OF THE INVENTION

In the manufacture of oriented strand board (OSB), the standard dryer, which has been used for many years, is a rotary dryer which utilizes flue gases from a boiler as the drying medium. Over the last five years or so, a limited number of conveyor dryers utilizing indirectly heated air as a medium have been manufactured, such as those by Proctor & Schwartz and George Koch Sons, Inc. These dryers operate at relatively low humidities which are related to the temperature conditions under which they are designed to operate. Examples of such dryers are disclosed in U.S. Pat. No. 5,524,361 and U.S. Pat. No. 5,341,580.

With conventional dryers, equipment must be utilized to detect and fight fires, which are not uncommon. In many installations, either to satisfy local regulations and/or to reduce operating costs, additional costly equipment must be utilized to control thermal and air pollution, to recover heat, and to increase the thermal efficiency of drying and drying rate. Furthermore, conventional dryers are not as fire proof, compact, or inexpensive to construct and operate as desired.

OBJECTS OF THE PRESENT INVENTION

With the foregoing in mind, a primary object of the present invention is to improve the efficiency of drying particulate matter.

Another object of the invention is to reduce the drying area required for a given capacity, in order to provide a dryer which would be less expensive and take up less space than if it were designed for conventional conditions.

Another object of the present invention is to provide a novel process for drying flammable particulate matter efficiently and in a manner that reduces the possibility of fires or other oxidation reactions.

A further object of the present invention is to provide an improved process for drying wood strands by advancing them on a conveyor through a chamber in which humidity and, possibly, temperature conditions are maintained above levels heretofore utilized in such drying processes in order to reduce the proportion of free oxygen in the drying medium.

SUMMARY OF THE INVENTION

More specifically, in the present invention, particulate cellulosic matter is dried as it advances through a chamber in which a drying medium is flowed under controlled conditions. In the process, the drying medium is maintained at a temperature and humidity above predetermined values where an increase in humidity causes an increase in heat transfer capability that offsets a reduction in mass transfer capability of the medium. As a result, the efficiency of drying of the particulate matter is enhanced. In the disclosed process, the particulate matter is composed of wood strands. Preferably, the temperature is maintained by controlling the rate of heat input to the drying medium and humidity is maintained by controlling the rate of exhaust of the drying medium from the chamber. The desired process parameters of temperature and humidity are set forth in the regions indicated on the accompanying operating chart.

BRIEF DESCRIPTION OF THE DRAWINGS

The foregoing and other objects, features and advantages of the present invention should become apparent from the following description when taken in conjunction with the accompanying drawing which illustrates a region of temperature and humidity drying conditions contemplated for operating the process according to the present invention.

DESCRIPTION OF THE PREFERRED PROCESS

In drying flammable particulate cellulosic matter, such as wood strands, chips, flakes, fines, sawdust, and the like as may be used in manufacturing oriented strand board (OSB), particle board, medium density fiber board or similar products, the particulate matter is advanced on a horizontal conveyor through a chamber, such as illustrated in U.S. Pat. Nos. 5,524,361 and 5,341,580, the disclosures which are incorporated by reference herein. In the aforementioned patented apparatus and others typically used for this purpose, the drying medium is flowed through the chamber and particulate matter bed to remove moisture and ancillary volatiles from the particulate matter as they advance from the inlet to the outlet. The humidity of the air is maintained at relatively low operating levels commensurate with standard practice at lower temperatures, and the desire to minimize the humidity level and thereby maximize the rate of drying mass transfer.

Before discussing the invention, a brief review of the psychometrics of drying is believed to be in order.

Turning now to the drawing, the left vertical axis sets forth absolute humidity expressed as the mass of water divided by the total mass of the mixture (water and dry air). The right vertical axis represents the oxygen content of the mixture expressed as a percentage of that normally found in standard, bone-dry air, where oxygen composes approximately 21% by volume of the air. The horizontal axis is dry bulb temperature expressed in degrees Fahrenheit. All values are for normal atmospheric pressure at sea level.

The left hand-curve S is the so-called saturation line found on most psychometric charts. It designates the maximum amount of water vapor that air can hold at a given temperature.

There is a so-called "inverse region" which is described in William Wasylenko and John F. Thygeson, *THE INVERSE POINT IN THROUGH CIRCULATION DRYING,* Aug. 30, 1976, 82nd National AIChE, Atlantic City, N.J. In this region, for a given temperature, an increase of humidity may increase, or decrease, drying rates depending upon the humidity level at a particular starting point. The lower temperature-humidity boundary of the inverse region I is indicated by the curve $I_l$. Below this curve, increasing humidity always reduces drying rate for a given temperature. The upper temperature-humidity boundary of the inverse region I is indicated by the curve $I_u$. Above this curve, increasing humidity always increases drying rate for a given temperature.

Conventional OSB dryers currently operate in the region indicated by the vertically elongate rectangle in single-cross hatched region A.

It is possible to operate OSB dryers in the region B indicted by the double-cross hatched lines B. Conditions in this region represent lower temperature levels than in the region A. Operating in the B region would typically be less commercial viable than operating in the A region due to the increase size of dryer required for a given evaporative capacity. Other process considerations, e.g. reduced VOC emissions, may warrant operation in the B region.

The uncrossed-hatched region indicated by C represents possible operation of certain dryer designs at humidities lower than in regions A or B. Operating in the C region would typically be less commercially viable than operating in either the A or B regions, because of increased exhaust volume and reduced thermal efficiency. There may, however, be other process or mechanical reasons for a dryer to operate in this region. For instance, a dryer operating at a capacity below its design value, and/or local conditions within the dryer due to leakage from the surroundings which may affect operating conditions.

As noted heretofore, while currently-available conveyor-type OSB dryers may function satisfactorily when operating in the region indicated by A, it is believed that certain advantages can be realized by operating in the region indicated by D, E, and F. This combined region is indicated to the right of the inverse region cure $I_u$, i.e., above about 300° F. and above a humidity level of approximately 0.70. In other words, as illustrated in the drawing, the combined regions D, E, and F have an approximately straight inverse curve low temperature boundary ($I_u$) that extends from about 300° F. at a humidity level of 1.0 to about 325° F. at a humidity of 0.70, and a high temperature boundary of about 600° F., all humidity values being controlled between 0.70 and 1.0.

Of the regions D, E, and F, an OSB conveyor dryer designed to operate in the region D is particularly commercially desirable because it could be designed without extensive or expensive changes from existing design parameters used in connection with current OSB and other types of particulate matter dryers. The region D is characterized horizontally by a temperature range from the inverse curve $I_u$ at about 325° F. rightward to approximately 500° F. and vertically from approximately 0.70 to approximately 0.85 humidity. In other words, as illustrated in the chart, region D has an approximately straight inverse curve low temperature boundary ($I_u$) that extends from about 310° F. at a humidity level of 0.85 to about 325° F. at a humidity level of 0.70, and a high temperature boundary of about 500° F., all humidity values being controlled between approximately 0.70 and 0.85. The right most boundary has been shown as approximately 500° F. because in OSB conveyor dryers, current heating sources are thermal oil systems which normally operate with oil temperatures ranging from 500° to 540° F., thus limiting the maximum temperature to which the drying medium can be heated.

The region indicated by E represents operating conditions at an even higher humidity level, and conveyor dryers designed to operate in this region would be comparatively more difficult to design and more expensive to operate due to the need for efficient dryer seals, among other equipment modifications. The region E has an approximately straight inverse curve low temperature boundary ($I_u$) that extends from about 300° F. at a humidity level of 1.0 to about 310° F. at a humidity level of 0.85, and a high temperature boundary of about 500° F., all humidity values being controlled between approximately 0.85 and 1.0. While operating a dryer in the region E is desirable, there may be offsetting practical and operating costs that may make it impractical.

The region indicated by F represents operating conditions that would be highly desirable, but most likely would require a conveyor dryer heat source other than one which utilizes thermal oil for indirectly heating the drying medium. The region F has a low temperature boundary at about 500° F., and a high temperature boundary of about 600° F., all humidity values being controlled between approximately 0.70 and 1.0. One possible example of a dryer that could operate in such a region would be a dryer designed to operate on heat extracted from flue gases from a furnace.

A dryer operating in the regions indicated by either D, E, or F, has certain advantages, such as the reduced need for fire extinguishing equipment due to the reduction in the amount of oxygen present in these regions and, hence, the lack of a fire-sustaining element. In addition, operations in these regions provides an increase in heat transfer capability, that offsets a reduction in mass transfer capability thereby reducing the drying area and enhancing the efficiency of drying of particulate matter, particularly OSB. All things considered, of these three regions, operating in the region D is the most practical considering the current state of the art of conveyor dryers.

While a preferred process has been described in detail, various modifications, alterations, and changes may be made without departing from the spirit or scope of the present invention as defined in the appended claims.

I claim:

1. In a process of drying cellulosic particulate matter as it advances through a chamber in which a drying medium is flowed, the improvement comprising the steps of maintaining the temperature of the medium between an approximately straight inverse curve low temperature boundary ($I_u$) that extends from about 300° F. at a humidity level of 1.0 to about 325° F. at a humidity level of 0.70, and a high boundary of 600° F., and controlling the humidity of the medium in a range between approximately 0.70 and approximately 1.0, whereby an increase in humidity causes an increase in heat transfer capability that offsets a reduction in mass transfer capability to thereby enhance the drying of the particulate matter.

2. The process according to claim 1 wherein said particulate matter is composed of cellulosic strands.

3. The process according to claim 1 wherein said maintaining step is effected by controlling the rate of exhaust of the drying medium from the chamber.

4. A process according to claim 1 in which the improvement comprises the steps of maintaining both the temperature of the medium between an approximately straight inverse curve low temperature boundary ($I_u$) that extends from about 310° F. at a humidity level of 0.85 to about 325° F. at a humidity level of 0.70, and a high temperature boundary of 500° F., with the humidity of the medium being controlled in a range between approximately 0.70 and approximately 0.85.

5. A process according to claim 1 in which the improvement comprises the steps of maintaining both the temperature and humidity of the medium between an approximately straight inverse curve low temperature boundary ($I_u$) that extends from about 300° F. at a humidity level of 1.0 to about 310° F. at a humidity level of 0.85, and a high temperature boundary of 500° F., with the humidity of the medium being controlled in a range between approximately 0.85 and approximately 1.0.

6. A process according to claim 1 in which the improvement comprises the steps of maintaining the temperature of the medium between a low temperature boundary of about 500° F. and a high temperature boundary of 600° F., with the humidity of the medium being controlled in a range between approximately 0.7 and approximately 1.0.

* * * * *